US010588347B2

(12) United States Patent
Malgat et al.

(10) Patent No.: US 10,588,347 B2
(45) Date of Patent: Mar. 17, 2020

(54) AEROSOL-GENERATING ARTICLE WITH RIGID HOLLOW TIP

(71) Applicant: PHILIP MORRIS PRODUCTS S.A., Neuchatel (CH)

(72) Inventors: Alexandre Malgat, Les Tuileries de Grandson (CH); Stephane Roudier, Colombier (CH); Ana Carolina Borges De Couraca, Lausanne (CH); Frederic Lavanchy, Chavornay (CH); Cedric Meyer, Lausanne (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 339 days.

(21) Appl. No.: 15/101,443

(22) PCT Filed: Dec. 4, 2014

(86) PCT No.: PCT/EP2014/076649
§ 371 (c)(1),
(2) Date: Jun. 3, 2016

(87) PCT Pub. No.: WO2015/082651
PCT Pub. Date: Jun. 11, 2015

(65) Prior Publication Data

US 2016/0309782 A1 Oct. 27, 2016

(30) Foreign Application Priority Data

Dec. 5, 2013 (EP) ..... 13195931

(51) Int. Cl.
*A24F 47/00* (2006.01)
*A24B 15/12* (2006.01)
*H05B 6/10* (2006.01)

(52) U.S. Cl.
CPC ..... *A24F 47/008* (2013.01); *A24B 15/12* (2013.01); *H05B 6/105* (2013.01)

(58) Field of Classification Search
CPC ..... A24F 47/008; A24F 47/004; A61M 15/06; H05B 6/105; A24B 15/12
See application file for complete search history.

(56) References Cited

U.S. PATENT DOCUMENTS 4,714,082 A * 12/1987 Banerjee ..... A24B 15/165 131/359
5,505,214 A * 4/1996 Collins ..... A24F 47/008 128/202.21

(Continued)

FOREIGN PATENT DOCUMENTS

CN 1190335 A 8/1998
CN 103315402 A 9/2013

(Continued)

OTHER PUBLICATIONS

International Search Report and Written Opinion of the International Searching Authority dated Mar. 2, 2015, in PCT/EP2014/076649 Filed Dec. 4, 2014.

(Continued)

*Primary Examiner* — Michael J Felton
*Assistant Examiner* — Jerzi H Moreno Hernandez
(74) *Attorney, Agent, or Firm* — Oblon, McClelland, Maier & Neustadt, L.L.P.

(57) ABSTRACT

A heated aerosol-generating article for use with an aerosol-generating device is provided, the heated aerosol-generating article including a plurality of components including an aerosol-forming substrate assembled within a wrapper to form a rod having a mouth end and a distal end upstream from the mouth end, in which a rigid hollow tube having an external diameter of between 5 mm and 15 mm and a length of between 5 mm and 15 mm is disposed upstream from the (Continued)

aerosol-forming substrate within the wrapper, the rigid hollow tube being substantially non-flammable and in which a pierceable film spans one end of the rigid hollow tube.

11 Claims, 4 Drawing Sheets

(56) References Cited

U.S. PATENT DOCUMENTS

| | | | | |
|---|---|---|---|---|
| 5,613,505 | A * | 3/1997 | Campbell | A24F 47/008 128/202.21 |
| 5,649,554 | A * | 7/1997 | Sprinkel | A24F 47/008 128/202.21 |
| 2004/0020500 | A1* | 2/2004 | Wrenn | A24C 5/478 131/194 |
| 2009/0293892 | A1* | 12/2009 | Williams | A24F 47/008 131/328 |
| 2010/0024834 | A1* | 2/2010 | Oglesby | A24F 47/006 131/194 |
| 2010/0200006 | A1* | 8/2010 | Robinson | A24F 47/008 131/194 |
| 2011/0126848 | A1* | 6/2011 | Zuber | A24F 47/008 131/329 |
| 2011/0192408 | A1* | 8/2011 | Inagaki | A24F 47/004 131/194 |
| 2013/0133675 | A1* | 5/2013 | Shinozaki | A24F 47/006 131/329 |
| 2014/0305448 | A1 | 10/2014 | Zuber et al. | |
| 2014/0338686 | A1 | 11/2014 | Plojoux et al. | |
| 2014/0373856 | A1 | 12/2014 | Zuber et al. | |
| 2015/0040929 | A1 | 2/2015 | Hon | |

FOREIGN PATENT DOCUMENTS

| | | | |
|---|---|---|---|
| WO | WO 2012/164009 | A2 | 12/2012 |
| WO | 2013/098405 | A2 | 7/2013 |
| WO | 2013/098409 | A1 | 7/2013 |
| WO | 2013/102609 | A2 | 7/2013 |
| WO | WO 2013/098410 | A2 | 7/2013 |
| WO | WO 2013/102614 | A2 | 7/2013 |
| WO | 2013/159245 | A1 | 10/2013 |

OTHER PUBLICATIONS

Combined Chinese Office Action and Search Report dated Jun. 26, 2018 in Patent Application No. 201480064050.4 (submitting English language translation only).

* cited by examiner

AEROSOL-GENERATING ARTICLE WITH RIGID HOLLOW TIP

TECHNICAL FIELD

The present specification relates to an aerosol-generating article comprising an aerosol-forming substrate for generating an inhalable aerosol when heated using an aerosol-generating device. The aerosol-generating article has a rigid, hollow, non-flammable tip at a distal end of the article. The specification also relates to a method of using such an aerosol-generating article.

DESCRIPTION OF THE RELATED ART

Aerosol-generating articles in which an aerosol-forming substrate, such as a tobacco containing substrate, is heated rather than combusted are known in the art. The aim of such heated aerosol-generating articles is to reduce known harmful smoke constituents produced by the combustion and pyrolytic degradation of tobacco in conventional cigarettes.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast in heated aerosol-generating articles, an inhalable aerosol is typically generated by the transfer of heat from a heat source to a physically separate aerosol-forming substrate or material, which may be located within, around or downstream of the heat source. During consumption, volatile compounds are released from the aerosol-forming substrate by heat transfer from the heat source and entrained in air drawn through the aerosol-generating article. As the released compounds cool, they condense to form an aerosol that is inhaled by the consumer.

Heated aerosol-generating articles comprising tobacco for generation of an aerosol by heating rather than burning are known in the art. For example, WO2013/102614 discloses an aerosol-generating system comprising a heated aerosol-generating article and an aerosol-generating device having a heater for heating the heated aerosol-generating article to produce an aerosol.

Tobacco used as part of an aerosol-forming substrate in heated aerosol-generating articles is designed to produce an aerosol when heated rather than when burned. Thus, such tobacco typically contains high levels of aerosol formers, such as glycerine or propylene glycol. If a user were to light a heated aerosol-generating article and smoke it as if it were a conventional cigarette that user would not receive the intended user experience. It would be desirable to produce a heated aerosol-generating article that has a lowered propensity for flame ignition. Such a heated aerosol-generating article would be preferably difficult to light during attempts to light the article with a lighter, such as a flame, in the manner of traditional cigarettes.

BRIEF DESCRIPTION OF THE DRAWINGS

Embodiments will now be further described, by way of example only, with reference to the accompanying drawings in which.

DETAILED DESCRIPTION

Figure 1:
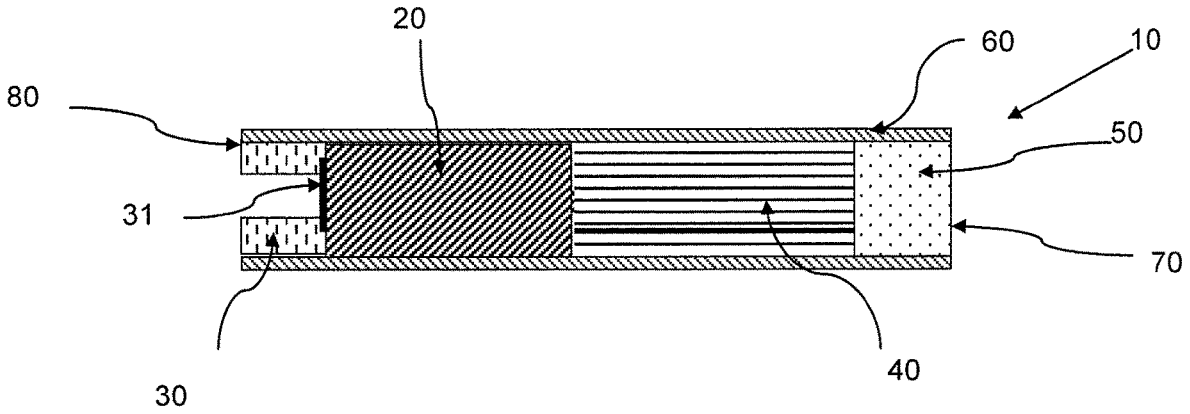
FIG. 1 is a schematic cross-sectional diagram of an embodiment of a heated aerosol-generating article for use with an aerosol generating-device.

A heated aerosol-generating article may be provided for use with an aerosol-generating device. The heated aerosol-generating article may comprise a plurality of components, including an aerosol-forming substrate, assembled within a wrapper to form a rod having a mouth end and a distal end upstream from the mouth end. The article further comprises a rigid hollow tube having an external diameter of between 5 mm and 15 mm and a length of between 5 mm and 15 mm. The rigid hollow tube is disposed upstream from the aerosol-forming substrate within the wrapper. The rigid hollow tube is formed from a substantially non-flammable material. As defined herein, a non-flammable material is a material that is difficult or impossible to ignite using a flame having a temperature of between 800° C. to 1700° C. and typically in the range of 800° C. to 1200° C. In general, any material that does not substantially release a toxic or otherwise harmful or undesirable compound in a temperature range between approximately 800° C. to 1200° C. or up to 1700° C. is within the substantially non-flammable materials contemplated herein. A pierceable film spans one end of the rigid hollow tube. The rigid hollow tube has a proximal end and a distal end. The pierceable film may span the distal end of the rigid hollow tube. The pierceable film may span the proximal end of the rigid hollow tube. The rigid hollow tube spanned by the pierceable film protects the distal end of the rod from ignition in case a user applies a flame and draws on the mouth end of the article. The heat from the flame impinges the hollow tube, which is non-flammable. The aerosol-forming substrate, located downstream of the rigid hollow tube is less likely to reach its combustion temperature than if it were located at the distal end of the heated aerosol-generating article. Furthermore, the pierceable film helps prevent air from being drawn through the rod. Thus, the risk of inadvertent or unintended ignition of the aerosol-forming substrate is reduced.

Preferably the rigid hollow tube is formed from a polymer, a metal or a ceramic. The rigid hollow tube is preferably formed from a material selected from the list consisting of metal foil, ceramic, highly filled paper, and Polyaryletherketone (PAEK) polymer.

The aerosol-generating article may be designed for use with an aerosol-aeneratina device comprising an insertable heating element for insertion into, and heating of, the aerosol-forming substrate. The rigid hollow tube defines a lumen or bore. The heating element may be inserted through the lumen or bore. The heating element may pierce the pierceable film as it is inserted through the rigid hollow tube. An insertion force for inserting the heating element into the aerosol-forming substrate may cause the aerosol-forming substrate to be displaced within the wrapper when the heater is inserted. It may be advantageous for the aerosol-generating article to comprise a second rigid hollow tube located immediately downstream of the aerosol-forming substrate to help prevent displacement of the aerosol-forming substrate.

The lumen or bore of the rigid hollow tube is spanned, at one or both ends, by a pierceable film or barrier. The pierceable film or barrier may act as a further barrier to protect the aerosol-forming substrate from an applied flame, and may be pierced or disrupted by a heating element of an aerosol-generating device. The pierceable film may be pierced by a piercing member that does not function as a heating element. The pierceable film is preferably formed from a material that substantially resists ignition from a flame source such as a match or lighter. The pierceable film may be formed from paper, a polymer, or metal.

It may be advantageous for the pierceable film to span the proximal end of the rigid hollow tube. The material forming the pierceable film may thus not need to be as flame resistant as if it were spanning the distal end of the rigid hollow tube. Furthermore, the rigid hollow tube may guide a piercing member, such as a heating element, into contact with the pierceable film.

In preferred embodiments the aerosol-forming substrate is in the form of an aerosol-generating rod comprising at least one gathered sheet of material. The gathered sheet of material may be a sheet of homogenised tobacco. The aerosol-forming substrate may be a rod of gathered tobacco as described in WO 2012/164009.

A heated aerosol-generating system may comprise a heated aerosol-generating article according to any embodiment described above, and an aerosol-generating device comprising means for heating the aerosol-forming substrate. The aerosol-generating device is arranged to engage with the heated aerosol-generating article to pierce the pierceable film, heat the aerosol-forming substrate and evolve an inhalable aerosol.

The aerosol-generating device may define a chamber for receiving the aerosol-generating article. The aerosol-generating device includes a means for heating the aerosol-forming substrate of the aerosol-generating article. Such means may comprise a heating element, for example a heating element that is insertable into the aerosol-generating article or a heating element that can be disposed adjacent to an aerosol-generating article. The heating means may comprise an inductor, for example an induction coil, for interacting with a susceptor.

A method of smoking or consuming an aerosol-generating article as described herein may comprise the steps of engaging the heated aerosol-generating article with an aerosol-generating device, piercing the pierceable film, actuating the aerosol-generating device to heat the aerosol-forming substrate, and drawing on the mouth end of the rod to cause air to flow through the rigid hollow tube and the pierced film, through the aerosol-forming substrate, and out of the aerosol-generating article through the mouth end.

As used herein, the term 'aerosol-forming substrate' is used to describe a substrate capable of releasing upon heating volatile compounds, which can form an aerosol. The aerosol generated from aerosol-forming substrates of aerosol-generating articles described herein may be visible or invisible and may include vapours (for example, fine particles of substances, which are in a gaseous state, that are ordinarily liquid or solid at room temperature) as well as gases and liquid droplets of condensed vapours.

As used herein, the terms 'upstream' and 'downstream' are used to describe the relative positions of elements, or portions of elements, of the heated aerosol-generating article in relation to the direction in which a user draws on the aerosol-generating article during use thereof.

The heated aerosol-generating article comprises two ends: a proximal end through which aerosol exits the aerosol-generating article and is delivered to a user and a distal end. In use, a user may draw on the proximal end in order to inhale aerosol generated by the aerosol-generating article.

The proximal end may also be referred to as the mouth end or the downstream end and is downstream of the distal end. The distal end may also be referred to as the upstream end and is upstream of the proximal end.

As used herein, the term 'aerosol-cooling element' is used to describe an element having a large surface area and a low resistance to draw. In use, an aerosol formed by volatile compounds released from the aerosol-forming substrate passes over and is cooled by the aerosol-cooling element before being inhaled by a user. In contrast to high resistance to draw filters and other mouthpieces, aerosol-cooling elements have a low resistance to draw. Chambers and cavities within an aerosol-generating article are also not considered to be aerosol cooling elements.

Preferably, the heated aerosol-generating article is a smoking article that generates an aerosol that is directly inhalable into a user's lungs through the user's mouth. More, preferably, the heated aerosol-generating article is a smoking article that generates a nicotine-containing aerosol that is directly inhalable into a user's lungs through the user's mouth.

As used herein, the term 'aerosol-generating device' is used to describe a device that interacts with an aerosol-forming substrate of an aerosol-generating article to generate an aerosol. Preferably, the aerosol-generating device is a smoking device that interacts with an aerosol-forming substrate of a heated aerosol-generating article to generate an aerosol that is directly inhalable into a user's lungs through the user's mouth. Preferably, the aerosol-generating device interacts with an aerosol-generating article to allow air to flow through the aerosol-forming substrate.

For the avoidance of doubt, in the following description the term 'heating element' is used to mean one or more heating elements.

In preferred embodiments, the aerosol-forming substrate is located at the upstream end of the aerosol-generating article.

As used herein, the term 'diameter' is used to describe the maximum dimension in the transverse direction of the aerosol-generating article. As used herein, the term 'length' is used to describe the maximum dimension in the longitudinal direction of the aerosol-generating article.

Preferably, the aerosol-forming substrate is a solid aerosol-forming substrate. The aerosol-forming substrate may comprise both solid and liquid components.

Preferably, the aerosol-forming substrate comprises nicotine. More preferably, the aerosol-forming substrate comprises tobacco.

Alternatively or in addition, the aerosol-forming substrate may comprise a non-tobacco containing aerosol-forming material.

If the aerosol-forming substrate is a solid aerosol-forming substrate, the solid aerosol-forming substrate may comprise, for example, one or more of: powder, granules, pellets, shreds, strands, strips or sheets containing one or more of: herb leaf, tobacco leaf, tobacco ribs, expanded tobacco and homogenised tobacco.

Optionally, the solid aerosol-forming substrate may contain tobacco or non-tobacco volatile flavour compounds, which are released upon heating of the solid aerosol-forming substrate. The solid aerosol-forming substrate may also contain one or more capsules that, for example, include additional tobacco volatile flavour compounds or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

In a preferred embodiment, the aerosol-forming substrate comprises homogenised tobacco material.

As used herein, the term 'homogenised tobacco material' denotes a material formed by agglomerating particulate tobacco.

Preferably, the aerosol-forming substrate comprises a gathered sheet of homogenised tobacco material.

As used herein, the term 'sheet' denotes a laminar element having a width and length substantially greater than the thickness thereof.

As used herein, the term 'gathered' is used to describe a sheet that is convoluted, folded, or otherwise compressed or constricted substantially transversely to the longitudinal axis of the aerosol-generating article.

Use of an aerosol-forming substrate comprising a gathered sheet of homogenised tobacco material advantageously significantly reduces the risk of 'loose ends' compared to an aerosol-forming substrate comprising shreds of tobacco material, that is the loss of shreds of tobacco material from the ends of the rod. Loose ends may disadvantageously lead to the need for more frequent cleaning of an aerosol-generating device for use with the aerosol-generating article and manufacturing equipment.

In a preferred embodiment, the aerosol-forming substrate comprises a gathered textured sheet of homogenised tobacco material.

As used herein, the term 'textured sheet' denotes a sheet that has been crimped, embossed, debossed, perforated or otherwise deformed. The aerosol-forming substrate may comprise a gathered textured sheet of homogenised tobacco material comprising a plurality of spaced-apart indentations, protrusions, perforations or a combination thereof.

In a particularly preferred embodiment, the aerosol-forming substrate comprises a gathered crimpled sheet of homogenised tobacco material.

Use of a textured sheet of homogenised tobacco material may advantageously facilitate gathering of the sheet of homogenised tobacco material to form the aerosol-forming substrate.

As used herein, the term 'crimped sheet' denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article. This advantageously facilitates gathering of the crimped sheet of homogenised tobacco material to form the aerosol-forming substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled.

In certain embodiments, the aerosol-forming substrate may comprise a gathered sheet of homogenised tobacco material that is substantially evenly textured over substantially its entire surface. For example, the aerosol-forming substrate may comprise a gathered crimped sheet of homogenised tobacco material comprising a plurality of substantially parallel ridges or corrugations that are substantially evenly spaced-apart across the width of the sheet. The aerosol-forming substrate may be in the form of a plug comprising an aerosol-forming material circumscribed by a paper or other wrapper. Where an aerosol-forming substrate is in the form of a plug, the entire plug including any wrapper is considered to be the aerosol-forming substrate.

In a preferred embodiment, the aerosol-generating substrate comprises a plug comprising a gathered textured sheet of homogenised tobacco material circumscribed by a wrapper. In a particularly preferred embodiment, the aerosol-generating substrate comprises a plug comprising a gathered crimped sheet of homogenised tobacco material circumscribed by a wrapper.

In certain embodiments, sheets of homogenised tobacco material for use in the aerosol-generating substrate may have a tobacco content of approximately 70% or more by weight on a dry weight basis.

Sheets of homogenised tobacco material for use in the aerosol-generating substrate may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material for use in the aerosol-generating substrate may comprise other additives including, but not limited to, tobacco and non-tobacco fibres, aerosol-formers, humectants, plasticisers, flavourants, fillers, aqueous and non-aqueous solvents and combinations thereof.

Suitable extrinsic binders for inclusion in sheets of homogenised tobacco material for use in the aerosol-generating substrate are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Suitable non-tobacco fibres for inclusion in sheets of homogenised tobacco material for use in the aerosol-generating substrate are known in the art and include, but are not limited to: cellulose fibres; soft-wood fibres; hard-wood fibres; jute fibres and combinations thereof. Prior to inclusion in sheets of homogenised tobacco material for use in the aerosol-generating substrate, non-tobacco fibres may be treated by suitable processes known in the art including, but not limited to: mechanical pulping; refining; chemical pulping; bleaching; sulphate pulping; and combinations thereof.

Sheets of homogenised tobacco material for use in the aerosol-generating substrate should have sufficiently high tensile strength to survive being gathered to form the aerosol-generating substrate. In certain embodiments non-tobacco fibres may be included in sheets of homogenised tobacco material for use in the aerosol-generating substrate in order to achieve an appropriate tensile strength.

For example, homogenised sheets of tobacco material for use in the aerosol-generating substrate may comprise between approximately 1% and approximately 5% non-tobacco fibres by weight on a dry weight basis.

Preferably, the aerosol-forming substrate comprises an aerosol former.

As used herein, the term 'aerosol former' is used to describe any suitable known compound or mixture of compounds that, in use, facilitates formation of an aerosol and that is substantially resistant to thermal degradation at the operating temperature of the aerosol-generating article.

Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate Preferred aerosol formers are polyhydric alcohols or mixtures thereof, such as propylene glycol, triethylene glycol, 1,3-butanediol and, most preferred, glycerine.

The aerosol-forming substrate may comprise a single aerosol former. Alternatively, the aerosol-forming substrate may comprise a combination of two or more aerosol formers.

Preferably, the aerosol-forming substrate has an aerosol former content of greater than 5% on a dry weight basis.

The aerosol aerosol-forming substrate may have an aerosol former content of between approximately 5% and approximately 30% on a dry weight basis.

In a preferred embodiment, the aerosol-forming substrate has an aerosol former content of approximately 20% on a dry weight basis.

Aerosol-forming substrates comprising gathered sheets of homogenised tobacco for use in the aerosol-generating article may be made by methods known in the art, for example the methods disclosed in WO 2012/164009 A2.

In a preferred embodiment sheets of homogenised tobacco material for use in the aerosol-generating article are formed from a slurry comprising particulate tobacco, guar gum, cellulose fibres and glycerine by a casting process.

The aerosol-forming substrate preferably has an external diameter that is approximately equal to the external diameter of the aerosol-generating article.

Preferably, the aerosol-forming substrate has an external diameter of at least 5 millimetres. The aerosol-forming substrate may have an external diameter of between approximately 5 millimetres and approximately 12 millimetres, for example of between approximately 5 millimetres and approximately 10 millimetres or of between approximately 6 millimetres and approximately 8 millimetres. In a preferred embodiment, the aerosol-forming substrate has an external diameter of 7.2 millimetres +/−10%.

The aerosol-forming substrate may have a length of between approximately 7 millimetres and approximately 15 mm. In one embodiment, the aerosol-forming substrate may have a length of approximately 10 millimetres. In a preferred embodiment, the aerosol-forming substrate has a length of approximately 12 millimetres.

Preferably, the aerosol-forming substrate is substantially cylindrical.

A rigid hollow tube is located upstream of the aerosol-forming substrate. The rigid hollow tube may be formed from any suitable material or combination of materials. In a preferred embodiment, the rigid hollow tube is formed from metal foil or ceramics, or another suitable thermally resistant material.

The rigid hollow tube preferably has an external diameter that is approximately equal to the external diameter of the aerosol-generating article.

The rigid hollow tube may have an external diameter of between approximately 5 millimetres and approximately 15 millimetres, for example of between approximately 5 millimetres and approximately 10 millimetres or of between approximately 6 millimetres and approximately 8 millimetres. In a preferred embodiment, the rigid hollow tube has an external diameter of 7.2 millimetres +/−10%.

The rigid hollow tube may have a length of between approximately 5 millimetres and approximately 15 mm. In a preferred embodiment, the rigid hollow tube has a length of approximately 8 millimetres.

A second rigid hollow tube may be located immediately downstream of the aerosol-forming article. Such a second rigid hollow tube may act as a support element. The dimensions and parameters given above for the rigid hollow tube may also be applicable for the second rigid hollow tube.

An aerosol-cooling element may be located downstream of the aerosol-forming substrate. For example, in some embodiments an aerosol-cooling element may be located immediately downstream of a support element downstream of the aerosol-forming substrate.

The aerosol-cooling element may be located between a support element and a mouthpiece located at the extreme downstream end of the aerosol-generating article.

The aerosol-cooling element may have a total surface area of between approximately 300 square millimetres per millimetre length and approximately 1000 square millimetres per millimetre length. In a preferred embodiment, the aerosol-cooling element has a total surface area of approximately 500 square millimetres per millimetre length.

The aerosol-cooling element may be alternatively termed a heat exchanger.

The aerosol-cooling element preferably has a low resistance to draw. That is, the aerosol-cooling element preferably offers a low resistance to the passage of air through the aerosol-generating article. Preferably, the aerosol-cooling element does not substantially affect the resistance to draw of the aerosol-generating article.

Preferably, the aerosol-cooling element has a porosity of between 50% and 90% in the longitudinal direction. The porosity of the aerosol-cooling element in the longitudinal direction is defined by the ratio of the cross-sectional area of material forming the aerosol-cooling element and the internal cross-sectional area of the aerosol-generating article at the position of the aerosol-cooling element.

The aerosol-cooling element may comprise a plurality of longitudinally extending channels. The plurality of longitudinally extending channels may be defined by a sheet material that has been one or more of crimped, pleated, gathered and folded to form the channels. The plurality of longitudinally extending channels may be defined by a single sheet that has been one or more of crimped, pleated, gathered and folded to form multiple channels. Alternatively, the plurality of longitudinally extending channels may be defined by multiple sheets that have been one or more of crimped, pleated, gathered and folded to form multiple channels.

The aerosol-cooling element may have an external diameter of a diameter of between approximately 5 millimetres and approximately 10 millimetres, for example of between approximately 6 millimetres and approximately 8 millimetres. In a preferred embodiment, the aerosol-cooling element has an external diameter of 7.2 millimetres +/−10%.

The aerosol-cooling element may have a length of between approximately 5 millimetres and approximately 25 mm. In a preferred embodiment, the aerosol-cooling element has a length of approximately 18 millimetres.

In some embodiments, the aerosol-cooling element may comprise a gathered sheet of material selected from the group consisting of metallic foil, polymeric material, and substantially non-porous paper or cardboard. In some embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In a preferred embodiment, the aerosol-cooling element comprises a gathered sheet of biodegradable polymeric material, such as polylactic acid or a grade of Mater-Bi® (a commercially available family of starch based copolyesters).

In a particularly preferred embodiment, the aerosol-cooling element comprises a gathered sheet of polylactic acid.

The aerosol-generating article may comprise a mouthpiece located at the downstream end of the aerosol-generating article.

The mouthpiece may be located immediately downstream of the aerosol-cooling element and abut the aerosol-cooling element.

The mouthpiece may comprise a filter. The filter may be formed from one or more suitable filtration materials. Many such filtration materials are known in the art. In one embodiment, the mouthpiece may comprise a filter formed from cellulose acetate tow.

The mouthpiece preferably has an external diameter that is approximately equal to the external diameter of the aerosol-generating article.

The mouthpiece may have an external diameter of a diameter of between approximately 5 millimetres and approximately 10 millimetres, for example of between approximately 6 millimetres and approximately 8 millimetres. In a preferred embodiment, the mouthpiece has an external diameter of 7.2 millimetres +/−10%.

The mouthpiece may have a length of between approximately 5 millimetres and approximately 20 millimetres. In a preferred embodiment, the mouthpiece has a length of approximately 14 millimetres.

The mouthpiece may have a length of between approximately 5 millimetres and approximately 14 millimetres. In a preferred embodiment, the mouthpiece has a length of approximately 7 millimetres.

The aerosol-forming substrate, and any other components of the heated aerosol-generating article are assembled within a circumscribing wrapper. The wrapper may be formed from any suitable material or combination of materials. Preferably, the outer wrapper is a cigarette paper.

A downstream end portion of the wrapper may be circumscribed by a band of tipping paper.

The appearance of the heated aerosol-generating article may simulate the appearance of a conventional lit-end cigarette.

The aerosol-generating article may have an external diameter of between approximately 5 millimetres and approximately 12 millimetres, for example of between approximately 6 millimetres and approximately 8 millimetres. In a preferred embodiment, the aerosol-generating article has an external diameter of 7.2 millimetres +/−10%.

The aerosol-generating article may have a total length of between approximately 30 millimetres and approximately 100 millimetres. In a preferred embodiment, the aerosol-generating article has a total length of approximately 45 millimetres.

A system may comprise the aerosol-generating article and an aerosol-generating device. The aerosol-generating device may comprise: a housing; a heating element; an electrical power supply connected to the heating element; and a control element configured to control the supply of power from the power supply to the heating element.

The housing may define a cavity surrounding the heating element, the cavity configured to receive the heated aerosol-generating article.

Preferably, the aerosol-generating device is a portable or handheld aerosol-generating device that is comfortable for a user to hold between the fingers of a single hand.

The aerosol-generating device may be substantially cylindrical in shape

The aerosol-generating device may have a length of between approximately 70 millimetres and approximately 120 millimetres.

The power supply may be any suitable power supply, for example a DC voltage source such as a battery. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery.

The control element may be a simple switch. Alternatively the control element may be electric circuitry and may comprise one or more microprocessors or microcontrollers.

The heating element of the aerosol-generating device may be any suitable heating element capable of being inserted into the aerosol-forming substrate of the aerosol-generating article. For example, the heating element may be in the form of a pin or blade.

The heating element may have a tapered, pointed or sharpened end to facilitate insertion of the heating element into the aerosol-forming substrate of the aerosol-generating article.

The resistance to draw (RTD) of the aerosol-generating article may be between approximately 80 mm WG and approximately 140 mm WG.

As used herein, resistance to draw is expressed with the units of pressure 'mm WG' or 'mm of water gauge' and is measured in accordance with ISO 6565:2002.

Features described in relation to one aspect or embodiment may also be applicable to other aspects and embodiments. For example, features described in relation to aerosol-generating articles and aerosol-generating systems described above may also be used in conjunction with methods of using aerosol-generating articles and aerosol-generating systems described above.

FIG. 1 illustrates a heated aerosol-generating article 10 according to a preferred embodiment. The aerosol-generating article 10 comprises four elements arranged in coaxial alignment: a rigid hollow tube 30, an aerosol-forming substrate 20, an aerosol-cooling element 40, and a mouthpiece 50. These four elements are arranged sequentially and are circumscribed by an outer wrapper 60 to form the heated aerosol-generating article 10. The aerosol-generating article 10 has a proximal or mouth end 70, which a user inserts into his or her mouth during use, and a distal end 80 located at the opposite end of the aerosol-generating article 10 to the mouth end 70. The proximal end of the rigid hollow tube 30 is spanned by a pierceable film 31, such as a polymer film. The pierceable film 31 may alternately be formed from other suitable materials such as metal foils, ceramics or papers. It is preferred that the film material resists ignition when a flame from a match or lighter is applied, although the position at the distal end of the rigid hollow tube prevents direct contact between the pierceable film 31 and a flame.

The distal end 80 of the aerosol-generating article may also be described as the upstream end of the aerosol-generating article 10 and the mouth end 70 of the aerosol-generating article 10 may also be described as the downstream end of the aerosol-generating article 10. Elements of the aerosol-generating article 10 located between the mouth end 70 and the distal end 80 can be described as being upstream of the mouth end 70 or, alternatively, downstream of the distal end 80.

The rigid hollow tube 30 is located at the extreme distal or upstream end of the aerosol-generating article 10. In the embodiment shown in FIG. 1, the rigid hollow tube 30 is a hollow ceramic tube. This rigid hollow tube 30 and its associated pierceable film 31 protect the aerosol-forming substrate from flames applied to the distal end of the article 10.

In the embodiment illustrated in FIG. 1, the aerosol-forming substrate 20 comprises a gathered sheet of crimped homogenised tobacco material circumscribed by a wrapper. The crimped sheet of homogenised tobacco material comprises comprising glycerine as an aerosol-former.

The aerosol-cooling element 40 is located immediately downstream of a support element, such as rigid hollow tube 30, and abuts the support element. In use, volatile substances released from the aerosol-forming substrate 20 pass along the aerosol-cooling element 40 towards the mouth end 70 of the aerosol-generating article 10. The volatile substances may cool within the aerosol-cooling element 40 to form an aerosol that is inhaled by the user. In the embodiment illustrated in FIG. 1, the aerosol-cooling element comprises a crimped and gathered sheet of polylactic acid circumscribed by a wrapper 90. The crimped and gathered sheet of polylactic acid defines a plurality of longitudinal channels that extend along the length of the aerosol-cooling element 40.

The mouthpiece 50 is located immediately downstream of the aerosol-cooling element 40 and abuts the aerosol-cooling element 40. In the embodiment illustrated in FIG. 1, the mouthpiece 50 comprises a conventional cellulose acetate tow filter of low filtration efficiency.

To assemble the aerosol-generating article 10, the four elements described above are aligned and tightly wrapped within the perforated outer wrapper 60. In the embodiment illustrated in FIG. 1, a distal end portion of the outer wrapper 60 of the aerosol-generating article 10 is circumscribed by a band of tipping paper (not shown).

The aerosol-generating article 10 illustrated in FIG. 1 is designed to engage with an aerosol-generating device comprising a heating element in order to be smoked or consumed by a user. In use, the heating element of the aerosol-generating device heats the aerosol-forming substrate 20 of the aerosol-generating article 10 to a sufficient temperature to form an aerosol, which is drawn downstream through the aerosol-generating article 10 and inhaled by the user.

Figure 2:
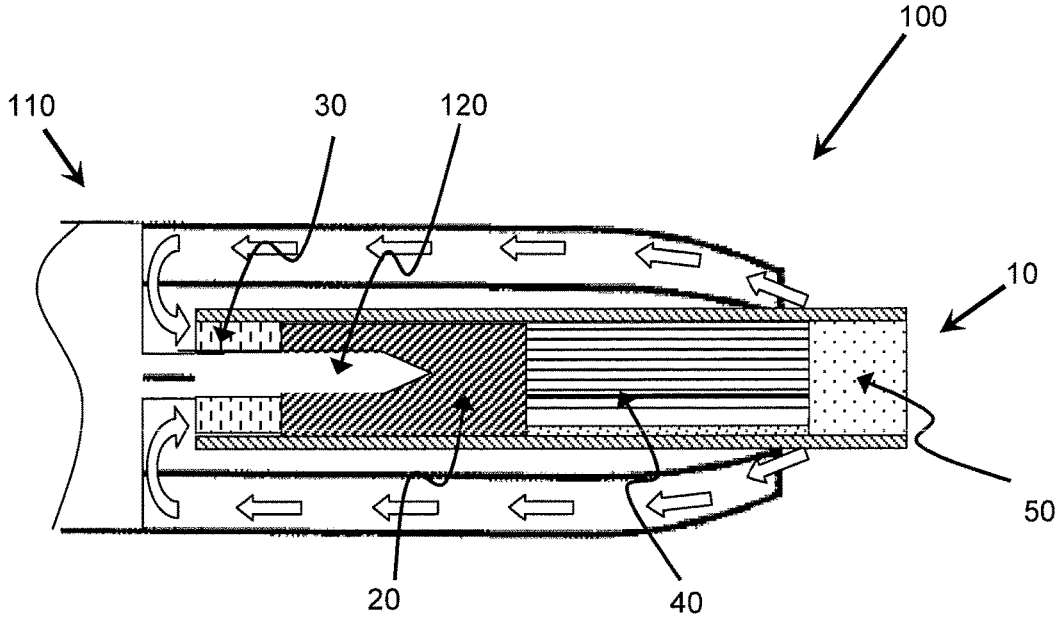
FIG. 2 is a schematic cross-sectional diagram of an embodiment of an aerosol-generating system comprising an electrically heated aerosol-generating device comprising a heating element, and an aerosol-generating article according to the embodiment illustrated in FIG. 1.

FIG. 2 illustrates a portion of an aerosol-generating system 100 comprising an aerosol-generating device 110 and an aerosol-generating article 10 according to the embodiment described above and illustrated in FIG. 1.

The aerosol-generating device comprises a heating element 120. As shown in FIG. 2, the heating element 120 is mounted within an aerosol-generating article receiving chamber of the aerosol-generating device 110. In use, the user inserts the aerosol-generating article 10 into the aerosol-generating article receiving chamber of the aerosol-generating device 110 such that the heating element 120 pierces the pierceable film 31 and is directly inserted into the aerosol-forming substrate 20 of the aerosol-generating article 10 through the lumen of the rigid hollow tube 30 as shown in FIG. 2. In the embodiment shown in FIG. 2, the heating element 120 of the aerosol-generating device 110 is a heater blade.

The aerosol-generating device 110 comprises a power supply and electronics that allow the heating element 120 to be actuated. Such actuation may be manually operated or may occur automatically in response to a user drawing on an aerosol-generating article 10 inserted into the aerosol-generating article receiving chamber of the aerosol-generating device 110. A plurality of openings is provided in the aerosol-generating device to allow air to flow to the aerosol-generating article 10; the direction of air flow is illustrated by arrows in FIG. 2. Once the pierceable film 31 is pierced, air can be drawn into the aerosol-generating article 10 through the rigid hollow tube 30.

Once the internal heating element 120 is inserted into the aerosol-forming substrate 10 actuated of the aerosol-generating article 10 and actuated, the aerosol-forming substrate 20 of the aerosol-generating article 10 is heated to a temperature of approximately 375 degrees Celsius by the heating element 120 of the aerosol-generating device 110. At this temperature, volatile compounds are evolved from the aerosol-forming substrate 20 of the aerosol-generating article 10. As a user draws on the mouth end 70 of the aerosol-generating article 10, the volatile compounds evolved from the aerosol-forming substrate 20 are drawn downstream through the aerosol-generating article 10 and condense to form an aerosol that is drawn through the mouthpiece 50 of the aerosol-generating article 10 into the user's mouth.

As the aerosol passes downstream thorough the aerosol-cooling element 40, the temperature of the aerosol is reduced due to transfer of thermal energy from the aerosol to the aerosol-cooling element 40. When the aerosol enters the aerosol-cooling element 40, its temperature is approximately 60 degrees Celsius. Due to cooling within the aerosol-cooling element 40, the temperature of the aerosol as it exits the aerosol-cooling element is approximately 40 degrees Celsius.

Figure 3:
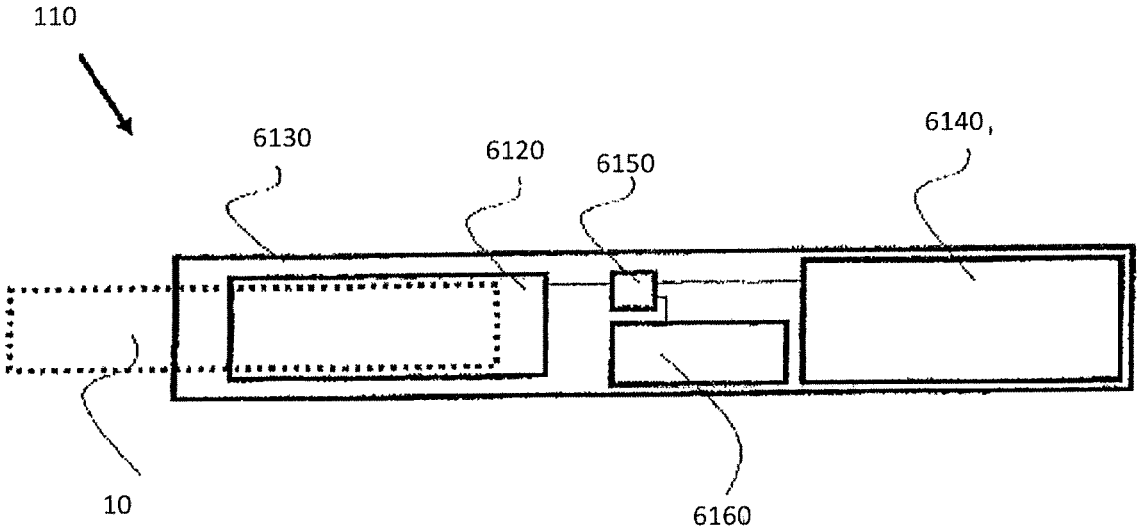
FIG. 3 is a schematic cross-sectional diagram of the aerosol-generating device illustrated in FIG. 2.

In FIG. 3, the components of the aerosol-generating device 110 are shown in a simplified manner. Particularly, the components of the aerosol-generating device 110 are not drawn to scale in FIG. 3. Components that are not relevant for the understanding of the embodiment have been omitted to simplify FIG. 3.

As shown in FIG. 3, the aerosol-generating device 110 comprises a housing 6130. The heating element 6120 is mounted within an aerosol-generating article receiving chamber within the housing 6130. The aerosol-generating article 10 (shown by dashed lines in FIG. 3) is inserted into the aerosol-generating article receiving chamber within the housing 6130 of the aerosol-generating device 110 such that the heating element 6120 is directly inserted into the aerosol-forming substrate 20 of the aerosol-generating article 10.

Within the housing 6130 there is an electrical energy supply 6140, for example a rechargeable lithium ion battery. A controller 6150 is connected to the heating element 6120, the electrical energy supply 6140, and a user interface 6160, for example a button or display. The controller 6150 controls the power supplied to the heating element 6120 in order to regulate its temperature.

Figure 4:
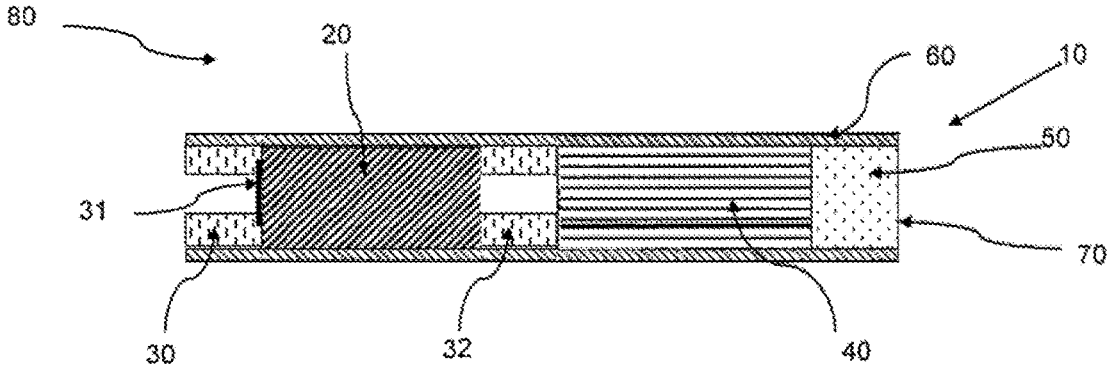
FIG. 4 is a schematic cross-sectional diagram of an embodiment of a heated aerosol-generating article shown in FIG. 1 and comprising a second rigid hollow tube.

FIG. 4 illustrates an embodiment of the heated aerosol-generating article 10 comprising a second rigid hollow tube 32. The second rigid hollow tube 32 is positioned immediately downstream of the aerosol-forming substrate 20. The second rigid hollow tube 32 acts as a support element and helps prevent displacement of the aerosol-forming substrate 20.

Figure 5:
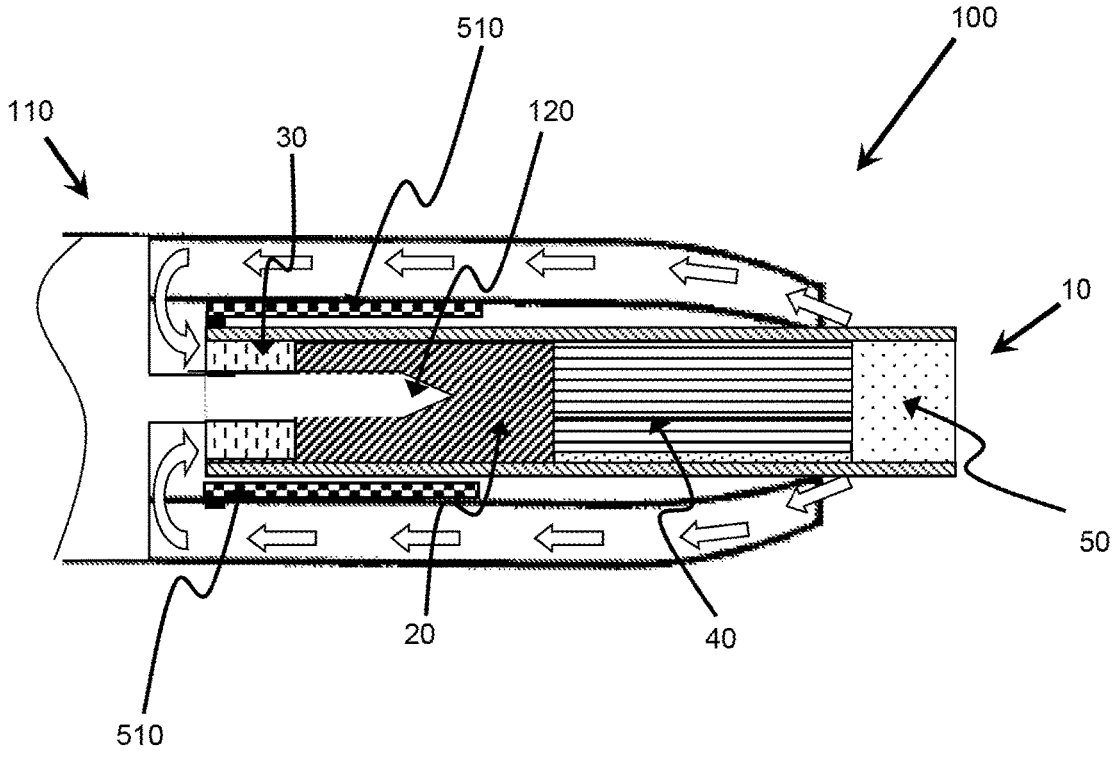
FIG. 5 is a schematic cross-sectional diagram of an embodiment of the aerosol-generating system of FIG. 2, where the electrically heated aerosol-generating device comprises radially spaced heating elements.

FIG. 5 illustrates an embodiment of the aerosol-generating system 100 comprising heater elements 510 radially spaced from the aerosol-generating article 10 when the aerosol-generating article 10 is engaged with the aerosol-generating device 110.

Figure 6:
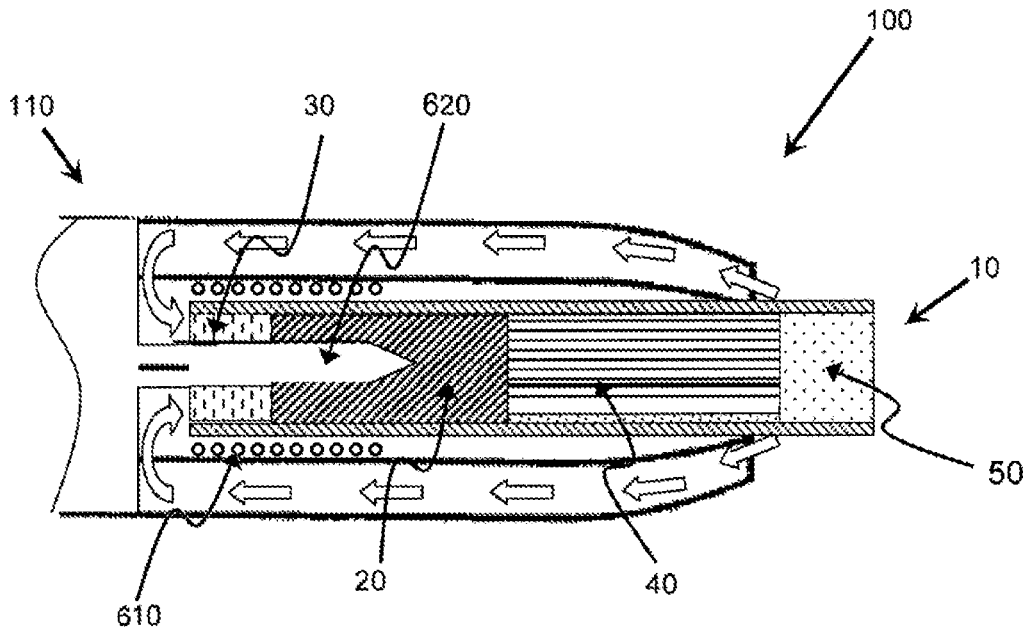
FIG. 6 is a schematic cross-sectional diagram of an embodiment of the aerosol-generating system of FIG. 2, comprising an inductor coil and where the heating element is a susceptor.

FIG. 6 illustrates an embodiment of the aerosol-generating system 100 comprising an inductor coil 610. In this embodiment, the heating element of the aerosol-generating device 110 is a susceptor 620.

The exemplary embodiments described above are not limiting. Other embodiments consistent with the exemplary embodiments described above will be apparent to those skilled in the art.

The invention claimed is:

1. A heated aerosol-generating article for an aerosol-generating device, the heated aerosol-generating article comprising:

a plurality of components including an aerosol-forming substrate assembled within a wrapper to form a rod having a mouth end and a distal end upstream from the mouth end;

a substantially non-flammable rigid hollow tube disposed upstream from the aerosol-forming substrate within the wrapper, said tube having an external diameter of between 5 mm and 15 mm and a length of between 5 mm and 15 mm; and a pierceable film spanning one end of the substantially non-flammable rigid hollow tube and being configured to protect the aerosol-forming substrate from an applied flame, such that the heated aerosol-generating article has a lowered propensity for flame ignition due to a presence of the pierceable film and of the substantially non-flammable rigid hollow tube.

2. The heated aerosol-generating article according to claim 1, wherein the substantially non-flammable rigid hollow tube is formed from a polymeric, a ceramic, or a metallic material.

3. The heated aerosol-generating article according to claim 1, wherein the substantially non-flammable rigid hollow tube is formed from a material selected from the list consisting of a metal foil, a ceramic, a highly filled paper, and a Polyaryletherketone (PAEK).

4. The heated aerosol-generating article according to claim 1, wherein a second rigid hollow tube is disposed downstream of the aerosol-forming substrate.

5. The heated aerosol-generating article according to claim 1, further comprising an aerosol-cooling element located downstream of the aerosol-forming substrate.

6. The heated aerosol-generating article according to claim 1, wherein the aerosol-forming substrate comprises a gathered sheet of homogenised tobacco.

7. A heated aerosol-generating system, comprising:

a heated aerosol-generating article, comprising:

a plurality of components including an aerosol-forming substrate assembled within a wrapper to form a rod having a mouth end and a distal end upstream from the mouth end, a substantially non-flammable rigid hollow tube disposed upstream from the aerosol-forming substrate within the wrapper, said tube having an external diameter of between 5 mm and 15 min and a length of between 5 mm and 15 mm, and a pierceable film spanning one end of the substantially non-flammable rigid hollow tube and being configured to protect the aerosol-forming substrate from an applied flame, such that the heated aerosol-generating article has a lowered propensity for flame ignition due to a presence of the pierceable film and of the substantially non-flammable rigid hollow tube; and an aerosol-generating device comprising means for heating the aerosol-forming substrate to generate an inhalable aerosol.

8. The heated aerosol-generating system according to claim 7, wherein the means for heating the aerosol-forming substrate comprises one or more heater elements insertable into the aerosol-forming substrate through a lumen of the substantially non-flammable rigid hollow tube.

9. The heated aerosol-generating system according to claim 7, wherein the means for heating the aerosol-forming substrate comprises one or more heater elements radially spaced from the aerosol-generating article when the aerosol-generating article is engaged with the aerosol-generating device.

10. The heated aerosol-generating system according to claim 7, wherein the means for heating the aerosol-forming substrate comprises an inductor for heating a susceptor.

11. A method of smoking a heated aerosol-generating article, the heated aerosol-generating article comprising:

a plurality of components including an aerosol-forming substrate assembled within a wrapper to form a rod having a mouth end and a distal end upstream from the mouth end, a substantially non-flammable rigid hollow tube disposed upstream from the aerosol-forming substrate within the wrapper, said tube having an external diameter of between 5 mm and 15 mm and a length of between 5 mm and 15 mm, and a pierceable film spanning one end of the substantially non-flammable rigid hollow tube and being configured to protect the aerosol-forming substrate from an applied flame, such that the heated aerosol-generating article has a lowered propensity for flame ignition due to a presence of the pierceable film and of the substantially non-flammable rigid hollow tube; and the method comprising:

engaging the heated aerosol-generating article with an aerosol-generating device for heating the aerosol-generating substrate;

actuating the aerosol-generating device to heat the aerosol-forming substrate; and drawing on the mouth end of the rod to cause air to flow into the heated aerosol-generating article through a lumen of the substantially non-flammable rigid hollow tube, through the aerosol-forming substrate, and out of the aerosol-generating article through the mouth end.

* * * * *